United States Patent [19]

Blachley

[11] Patent Number: 5,066,958

[45] Date of Patent: Nov. 19, 1991

[54] DUAL FREQUENCY COAXIAL FEED ASSEMBLY

[75] Inventor: Gerry B. Blachley, Simi Valley, Calif.

[73] Assignee: Antenna Down Link, Inc., Las Vegas, Nev.

[21] Appl. No.: 389,014

[22] Filed: Aug. 2, 1989

[51] Int. Cl.[5] ..... H01Q 13/02

[52] U.S. Cl. ..... 343/756; 343/776; 343/786; 333/21 A; 333/24.3

[58] Field of Search ..... 343/776, 756, 766, 786; 333/21 A, 135, 24.3

[56] References Cited

U.S. PATENT DOCUMENTS

| | | | |
|---|---|---|---|
| 4,504,836 | 3/1985 | Seavy | 343/761 |
| 4,544,900 | 10/1985 | Howard | 333/21 A |
| 4,554,552 | 11/1985 | Alford et al. | 343/786 |
| 4,554,553 | 11/1985 | Grim | 343/786 |
| 4,679,009 | 7/1987 | Cloutier | 343/766 X |
| 4,740,795 | 4/1988 | Seavey | 343/786 |
| 4,801,945 | 1/1989 | Luly | 343/786 |
| 4,862,187 | 8/1989 | Hom | 343/786 |
| 4,903,037 | 2/1990 | Mitchell et al. | 343/786 |
| 4,910,527 | 3/1990 | Dushane et al. | 343/786 |

OTHER PUBLICATIONS

Koch et al., "Coaxial Radiator as Feed for Low Noise Paraboloid Antennas," Nachrichtentech, Z., vol. 22; pp. 166–173, 1969.

Jeuken et al., "A Dual Frequency, Dual Polarized Feed for Radioastronomical Applications," *Nachrichtentech*, Z.; vol. 25, pp. 374–376, 1972.

Livington, "Multifrequency Coaxial Cavity Apex Feeds," *Microwave Journal*, vol. 22, pp. 51–54, Oct. 1979.

IEEE Transaction on Antennas & Propagation, vol. AP-34, No. 8, Aug., 1986 "Input Mismatch of $TE_{11}$ Feeds Mode Coaxial Waveguide," Trevor S. Bird, Grameme L. James & Stephen J. Skinner; pp. 1030–1033.

IEEE Transactions on Microwave Theory & Techniques, vol. MTT-35; No. 4 Apr., 1987, "Admittance of Irises in Coaxial & Circular Waveguides for $TE_{1-1}$-Mode Excitation," Graeme L. James; pp. 430–434.

*Primary Examiner*—Michael C. Wimer

*Attorney, Agent, or Firm*—Pretty, Schroeder Brueggemann & Clark

[57] ABSTRACT

A dual frequency feed assembly employing a pair of coaxial circular wave guide cavities, each with respective probe. The higher frequency cavity, e.g. Ku band, is located within the lower frequency, e.g. C band cavity. A common motor is used to drive the two probes which have a common axis A. The lower frequency probe is coupled through the rear wall of the assembly to a rectangular waveguide. The higher frequency probe is also coupled through the rear wall of the assembly but via a coaxial line which is diverted from the axis A to exit beside the lower frequency waveguide. The two rectangular waveguides and the drive motor for the probes are all mounted on the rear of the assembly. In one embodiment of the invention the coaxial line extends from its probe to a housing on the body containing a signal processing circuit board. Connection to that board is made directly eliminating the need for any waveguide transmission line. In other embodiments of the invention, electronic switches, for example, ferrite switches are used in place of rotating probes. The probes may then be fixed and their coaxial lines fixed as well.

8 Claims, 4 Drawing Sheets

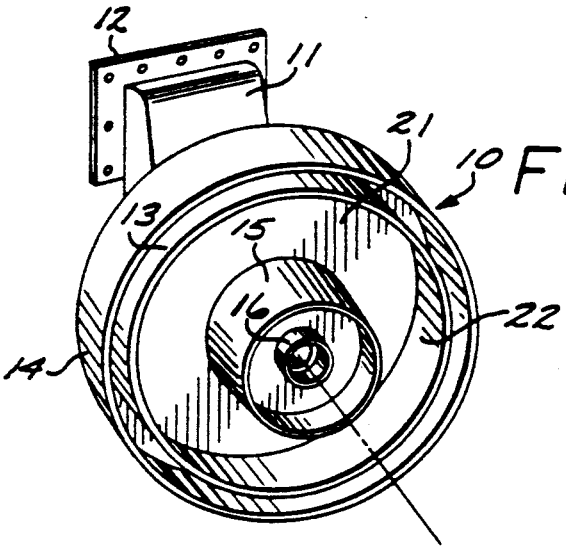
FIG. 1
FIG. 2
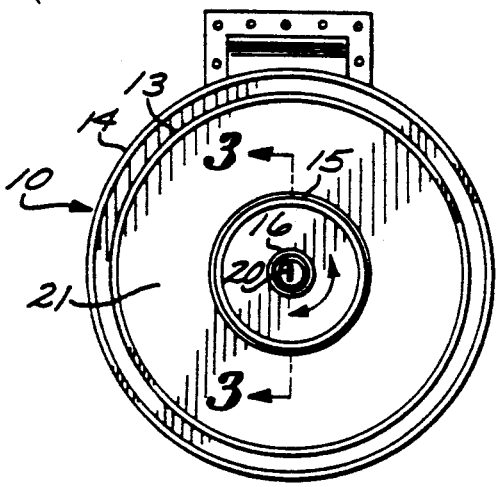
FIG. 3
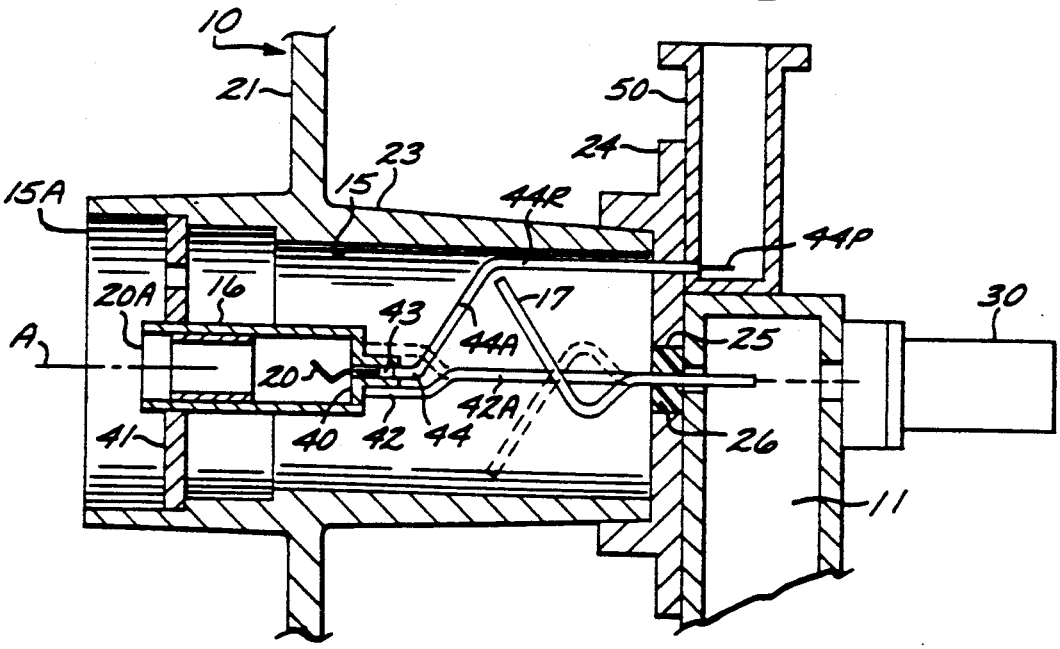

FIG. 4
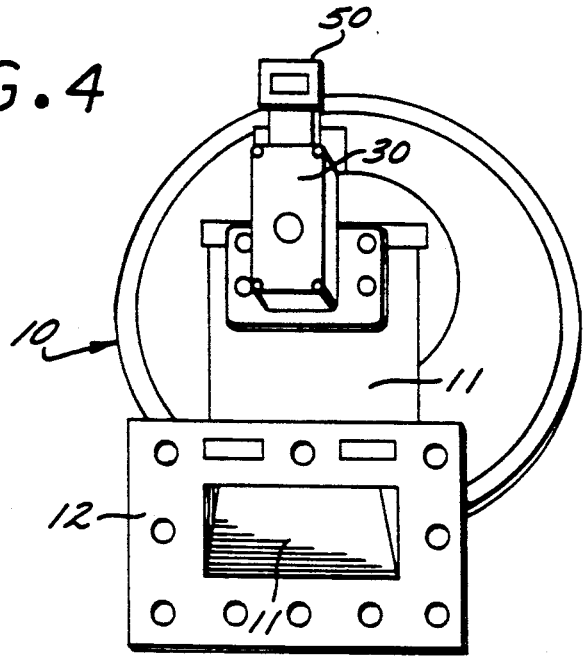
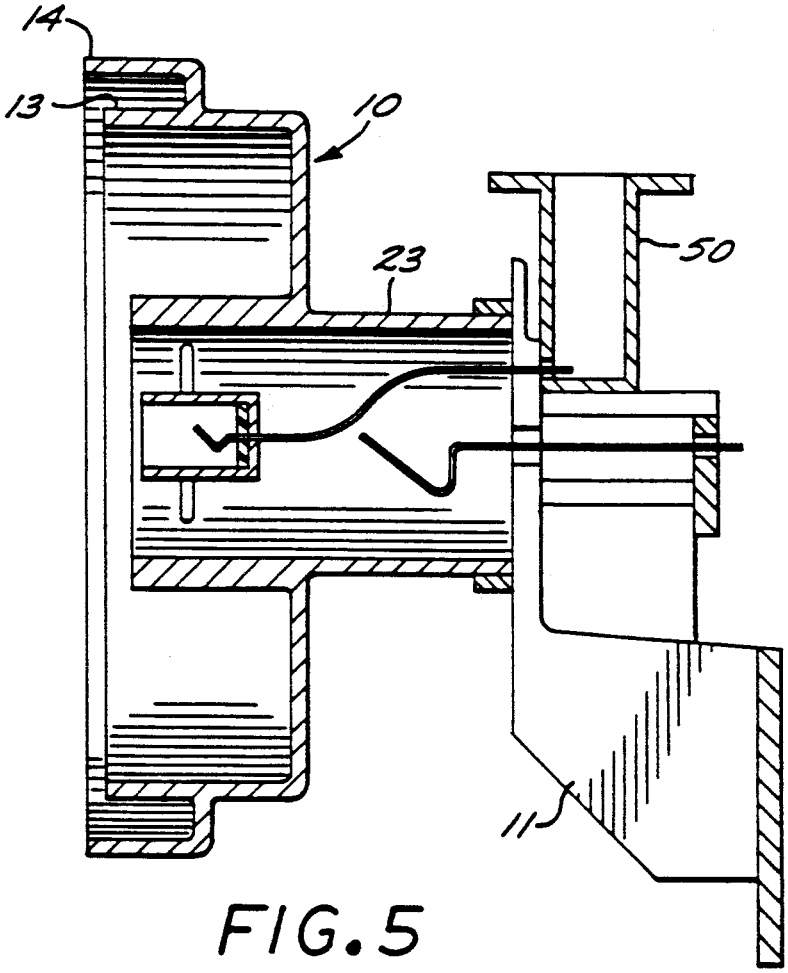
FIG. 5

DUAL FREQUENCY COAXIAL FEED ASSEMBLY

BACKGROUND OF THE INVENTION

With the advent of two predominant frequency bands for reception of satellite repeater television communication, the Ku band and the C band significant advances have been needed in feed horn assembly designs. It has been the desire to develop truly coaxial feed assemblies and this I have achieved in my co-pending application, Ser. No. 105,135, now U.S. Pat. No. 4,903,037. In that dual frequency feed, a pair of cavities or open-ended circular waveguides are located coaxially with the Ku band cavity located inside of the C band cavity. A rotatable probe is located in each cavity and they are coupled together for simultaneous rotation from a common drive source with the drive shaft preferably entering from the rear of the C band cavity.

The coupling of the Ku band probe has presented some difficulty since its normal exit direction through the rear of the C band cavity would place it in direct interference with the C band probe. I avoided this problem with my co-pending application by the use of a radically extending coaxial line. Other approaches to coaxial dual frequency feed assemblies are illustrated in the following U.S. Patent:

| U.S. Pat. No. | Inventor | Issued |
|---|---|---|
| 4,740,795 | John M. Seavey | April 26, 1988 |

The foregoing constitute, a rather complex structure, both mechanically and electrically. Single frequency band feeds with the signal from the probes being extracted from the rear of the feed are illustrated in the following:

| U.S. Pat. No. | Inventor | Issued |
|---|---|---|
| 4,528,528 | E. P. Augustin | July 9, 1985 |
| 4,414,516 | H. T. Howard | November 8, 1983 |
| 4,554,553 | F. Grim | November 19, 1985 |
| 4,504,836 | J. M. Seavey | March 12, 1985 |

A single frequency band system does not encounter the problem of mechanical and electrical interference between the probes and their coaxial lines.

BRIEF DESCRIPTION OF THE INVENTION

I have found that in addition to the method of extracting received signals from the Ku band probe via the side wall of the C band cavity or out the front face of the assembly as I proposed in my earlier application, referenced above, that it is possible for the Ku band signal to be extracted at the rear. Such an extraction was not practical when using a C band probe of a three sided rectangular shape as is disclosed in U.S. Pat. No. 4,414,516 to A. T. Howard or an L shaped probe of the type disclosed in U.S. Pat. No. 4,528,528 to E. P. Augustin because each of these include a portion of the probe which sweeps around the interior of the C band cavity with insufficient clearance for rear exit of the probe.

I have determined that it is possible to have a axial rear exit conductor from the Ku band cavity which is diverted sidewardly and rearwardly to exit through the rear wall of the C band cavity when used in combination with a C band probe of a hook shaped as disclosed in U.S. Pat. No. 2,880,399 to E. J. Murphy. In this combination the Ku band probe is coupled by a slip coupling to its output conductor and is affixed to the body or a portion of the body defining the Ku band cavity. A member extends from the C band probe root and engages the Ku band body or the rotating portion thereof to cause a rotation of the Ku band probe with rotation of the C band probe. This allows a single motor to drive both probes as is accomplished in my invention U.S. patent application, referenced above. In this case the rear of the feed assembly includes a C band waveguide section, a Ku band waveguide section and a drive motor all in non-interfering positions.

I have also discovered that it is possible to use ferrite switching devices for either one or both of the frequency bands with respective pickup probes located coaxially within their respective cavities and provide electronic rather than mechanical switching of polarization within each cavity.

In another embodiment of this invention I have provided for direct feeding of signals from the coaxial lines to an integrated circuit board without the need of a waveguide and its needed transform and inherent losses.

BRIEF DESCRIPTION OF THE DRAWING

This invention may be more clearly understood by the following detailed description and by reference to the drawing in which:

FIG. 1 is a perspective view of the front face of a dual frequency feed assembly incorporated in this invention;

FIG. 2 is a front face view thereof;

FIG. 3 is a fragmentary sectional view taken along line 3—3 of FIG. 2;

FIG. 4 is a rear elevational view thereof;

FIG. 5 is a diametrical sectional view of an alternate embodiment of this invention;

DETAILED DESCRIPTION OF THE INVENTION

Figure 6:
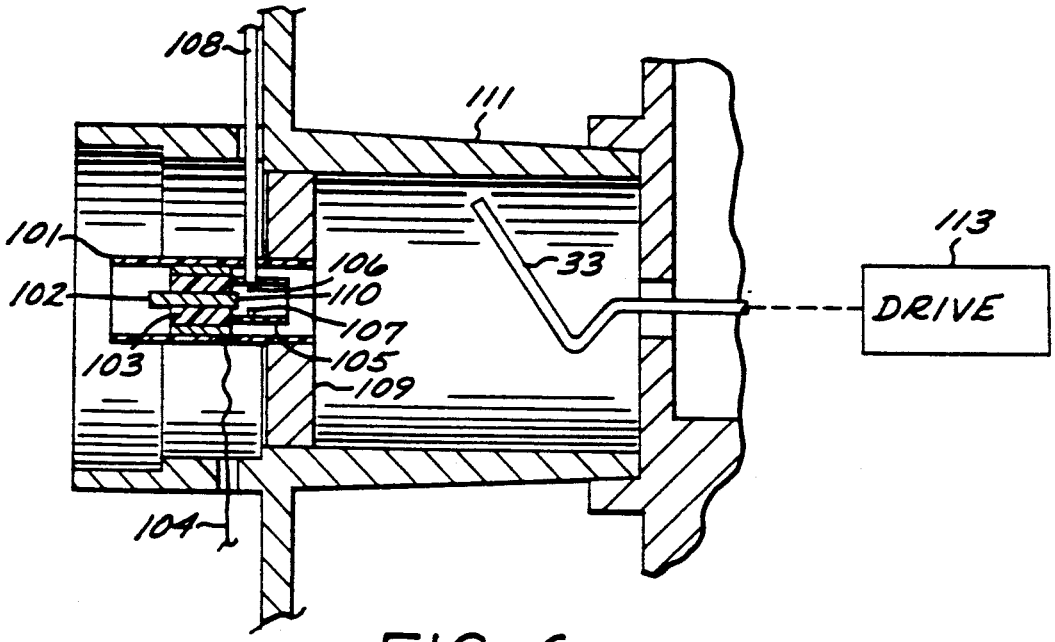
FIG. 6 is a diametrical section of a dual frequency feed assembly in which the higher frequency (e.g. Ku band) switching is accomplished using a ferrite switch.

Now referring to FIGS. 1–3, a dual frequency feed assembly, generally designated 10, may be seen therein with a C band waveguide 11 with its flange 12 located at the rear face of the assembly. The front face of the assembly shows a pair of annular rings 13 and 14 which ar coaxial with C band circular waveguide or cavity 15. Coaxially located within C band cavity 15 is a Ku band circular waveguide or cavity 16 with its associated probe 20.

Concealed behind the Ku band cavity 16 is the C band probe which may best be seen in FIGS. 3 and 5. A radially extending wall 21 of the assembly 10 is preferably integral with the side walls 22, the rings 13 and 14 and with a rear extension 23 appearing in FIGS. 3, 4 and 5. The extension 23 defines the major length of the C band cavity 15. A rear flange 24 which may be seen in FIGS. 3 and 5 provides:

a) A closure for the rear C band cavity;

b) A mounting hole 25 for a bearing 26 for the C band probe; as well as, c) A mounting structure for:

1. A drive motor 30;
2. The C band waveguide 11 of FIGS. 1 and 5; and
3. The Ku band waveguide 50 of FIGS. 3, 4 and 5.

Now referring specifically to FIG. 3, it may be seen there that the C band cavity 15 is substantially larger in diameter and greater in length than the Ku band cavity 20, as is to be expected, since C band frequency range is lower namely 3.7–4.2 GHz and the Ku band is in the optional 10.95–11.7 GHz range and 11.7–12.2 GHz mandatory range. As illustrated in FIG. 3 the Ku band probe 20 is located at the rear of the Ku band cavity and exposed to electromagnetic energy entering through the aperture 20*a* of cavity 20. The probe 20 is mechanically secured to rear flange 40 of the Ku band cavity 20 for rotation with the Ku band cavity within the front bearing/spacer 41 which maintains the Ku band cavity coaxially along axis A within the C band cavity 15. The bearing/spacer 41 is preferably of dielectric electromagnetic energy transparent material and may be in disc form as shown in FIG. 3 or on the form of a spider with three or more legs as illustrated in FIG. 5.

The Ku band cavity 20 is secured at its end wall 40 to an eccentric support and rotating shaft 42 including an axial section 42A which is coaxial with the axis A and with the bearing 26 so that rotation of the drive shaft associated with drive motor 30 produces simultaneous rotation of the C band probe 17 the shaft 42 and rotation of the Ku band cavity 20 and its cavity 16 and its probe 20. The probe 20 is coupled through slip joint 43 to a coaxial line 44 which includes an angle portion 44A which extends towards the edge of the C band cavity while maintaining clearance from the C band probe 17 regardless of its orientation. The rear straight portion 44R of the coaxial line 44 extends through the rear face of the rear flange 24 through the wall of the Ku band waveguide section 50 at the rear of the entire sampling and includes a probe 44P in coupling relationship with the Ku band waveguide section 50. The C band probe 17 extends into the C band waveguide 11 for coupling energy from the C band probe 17 which arrives at the C band aperture 15A. In FIG. 3 the extreme opposite position of the C band probe and the drive 44 are indicated by dashed lines. It should be noted that there is no interference between the C band probe and the coaxial line 44. This allows all of the mechanical components used to extract energy from the drive, as well as the drive motor 30, to be located at the rear of the assembly 10. This may be clearly seen.

As best seen in FIGS. 4 and 5, the ends of the C band wave guide 11 and Ku band waveguide generally abut while the motor drive 30 is secured to the outer wall of the wave guide 11. The drive motor or its gearbox 30 are aligned with axis A in a simple effective assembly. This is all accomplished since energy detected by both probes 17 and 20 is extracted through the rear of the assembly 10.

Now referring specifically to FIG. 6, it may be seen therein that another form of switching of the higher (e.g. Ku band) polarization without a rotating probe is possible. This totally eliminates rotational interference between the assembly elements. When no physical rotation is encountered, a sidewall signal extraction becomes more practical. In FIG. 6, a Ku band aperture is formed by tube 101 which encloses a signal receiving probe 102 surrounded by ferrite polarization rotator 103 with its coil through which direct current produces a polarization reversing field in the ferrite 103. Control signals are applied to the ferrite 103 coil via leads 104. Behind the probe 102 is rectangular waveguide 105 into which either vertical or horizontally polarized signals at the aperture of tube 101 are introduced. In certain cases, tuning of the rectangular waveguide may be necessary and a tuning probe 107, may be used in accordance with well known practice in the waveguide art.

A Ku band probe 106 extends into the rectangular waveguide 105 and extracts the detected Ku band signal for transmission over coaxial line 108 to the signal utilization device for the signal(unshown). The Ku band assembly and ferrite rotator are supported in the C band cavity 111 by dielectric ring 109. Signals received at probe 102 are introduced into the rectangular waveguide 105 at the probe's inner or transmitting end 110. As in the foregoing embodiments, the Ku band assembly is all coaxially located in the C band circular waveguide 111. The C band probe 33 is rotated by drive 113, similar to the previously described embodiments.

Figure 7:
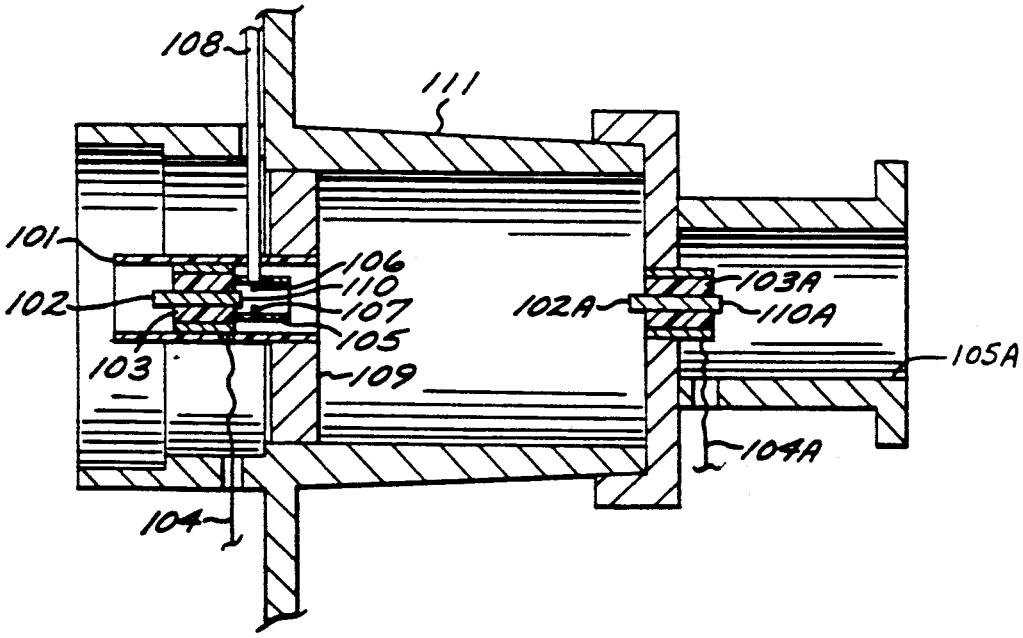
FIG. 7 is a diametrical section of a similar feed assembly in which both the higher and lower frequency switching of polarization is done electronically using ferrite switch elements.

Carrying this concept of ferrite switching in dual frequency band coaxial assemblies one step farther, the dual frequency feed assembly may employ ferrite switching for both the higher frequency and lower frequency probes. Such an arrangement is illustrated in FIG. 7 in which the same reference numbers are applied to the corresponding elements of FIG. 6. In addition to the higher frequency band cavity with its ferrite switch 103, the assembly includes a lower frequency, C band probe 102A and ferrite switch 103A with a lead 104A extending into a rectangular waveguide 105A.

Signals received at the probe 102A are introduced into the rectangular waveguide 105A at the probe's inner or transmitting end 110A.

Figure 8:
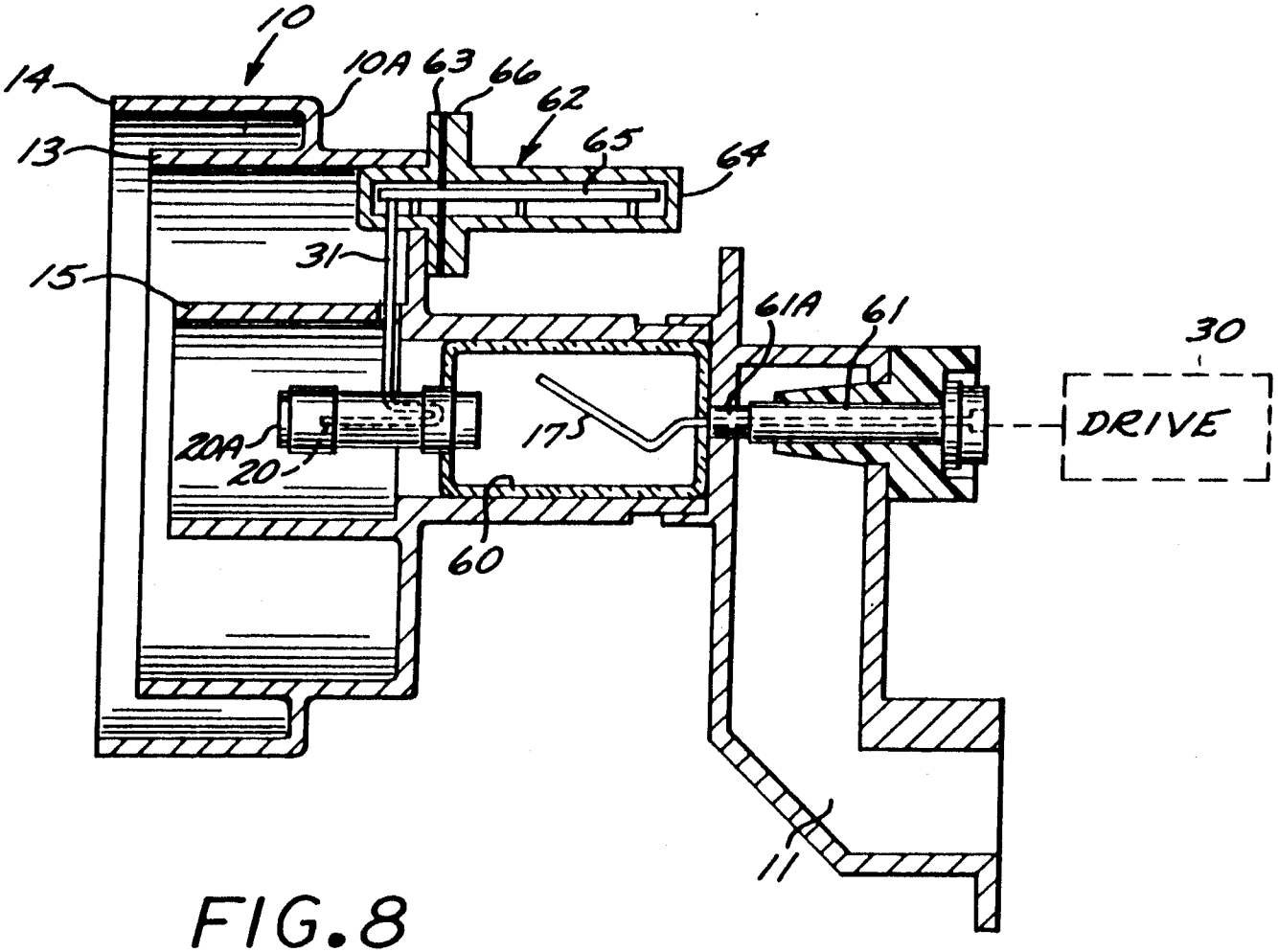
FIG. 8 is a diametrical section of a dual frequency feed assembly in which the higher frequency signal is fed directly by coaxial line to an integrated circuit board rather than through a waveguide.

One other aspect of this invention is illustrated in FIG. 8 as an alternate high frequency signal conductor arrangement. The embodiment is based upon the dual frequency version of my copending patent application Ser. No. 105,135, now U.S. Pat. No. 4,903,037. FIG. 2, to which reference is now made and the specification thereof is hereby incorporated by reference. For ease of understanding of this embodiment as well, the same reference numerals used in the previous embodiments are used in this figure of the drawing.

The dual frequency feed assembly 10 includes a main body 10A with a pair of encircling rings 13 and 14 surrounding the C band aperture 15 of the C band circular waveguide or cavity. A Ku band cavity with its aperture 20A is supported in the C band cavity by harp 60 for rotation with the C band probe 17 under the control of drive 30. C band signals detected by the C band probe 17 are extracted by introduction into waveguide 11 as the probe extension extends through the waveguide 11 through thermal isolator 61 with its integral bearing portion 61A between the waveguide 11 and the drive 30 which preferably is a miniature d. c. motor and reduction gear contained within a housing mounted on the assembly 10.

Of particular importance with respect to this embodiment is the fact that a coaxial line 30 which extends into signal transfer relationship with the Ku band probe 20 contained within the aperture 20 A, extends out of the Ku band cavity, through a wall of the C band cavity and into a housing 62 which is made up of two housing parts, an inner housing part 63 and an outer housing 64 which contain a signal processing circuit board 65 carrying the required integrated circuits for signal processing. The coaxial line 30 connects directly to the circuit contained in board 65 so no waveguide transformation is required. Signal processing for the Ku band is conducted directly on the feed assembly 10 itself. This significantly reduces the cost and adds to the reliability of the system. The line 30 is coupled to the probe 20 via a rotating joint in the Ku band cavity so that rotation of the Ku band probe 20 by the drive 30 through the harp 60 allows the line 30 to be fixed. The housing 62 is sealed against the elements by gasket 66 and includes a suitable weathertight connector (unshown in the drawing) for conducting the processed signal from the assembly 10 in accordance with well known practices in the electronics art. The connector and cable will be selected depending upon the frequency, bandwidth and shielding requirements of the signal after its processing on the board 65.

Each of the foregoing embodiments constitute important refinements in the dual frequency feed assembly of my copending application Ser. No. 105,135, now U.S. Pat. No. 4,903,037. The refinements maintain the basic principle of that invention while adding to its adaptability and utility.

The foregoing constitute the best mode known by the applicant for carrying out this invention however, the specific embodiments disclosed are illustrative of the principle of the invention and are not limiting in its scope. To the contrary, it is recognized that one of ordinary skill in the art, given this teaching, may make variations in the structure or compositions without departing from the spirit and scope of this invention. Its scope is defined by the following claims including the protection offered by the doctrine of equivalents.

What is claimed is:

1. A dual frequency, coaxial feed assembly for receiving electromagnetic signals and conveying them to a signal utilization means outside of said coaxial feed assembly, comprising:

a body defining a front aperture and a first closed rear waveguide cavity therein having at least one sidewall and an end wall;

a first probe mounted within said first waveguide cavity for receiving electomagnetic energy in a first preselected band of frequencies;

means conducting electromagnetic energy received by said first probe through the rear of said body to a signal utilization means;

means defining a second front aperture and second closed rear waveguie cavity therein of smaller dimension than said first closed rear waveguide cavity;

a second probe mounted within said second waveguide cavity for receiving electomagnetic energy in a second preselected band of frequencies, said second preselected band of frequencies being higher than said first band of frequencies;

support means supporting said second probe in said second waveguide cavity;

means mounting said second waveguide cavity coaxially within said first waveguide cavity and spaced apart from each of the walls of said first waveguide cavity;

wherein the support means includes electronic switch means for changing the polarization of incident energy received by at least one of said first probe and second probe;

control lead means for carrying electrical control signals to said electronic switch means, to control the polarization of incident energy received by at least one of said first probe and second probe;

a coaxial line extending into said first waveguide cavity, spaced from said first probe, for conducting electromagnetic energy received by said second probe to the exterior of said assembly.

2. A coaxial, dual frequency feed assembly in accordance with claim 1, wherein said electronic switch means comprises a ferrite rotator.

3. A coaxial, dual frequency feed assembly in accordance with claim 1, wherein said electronic switch means is positioned in said second cavity, for controlling the polarization of signals detected by the second probe.

4. A coaxial, dual frequency feed assembly in accordance with claim 1, wherein:

said electronic switch means includes means for changing the polarization of incident energy received by both said first probe and said second probe; and said control means includes means for carrying electrical control signals to said electronic switch means to control the polarization of incident energy received by both said first probe and said second probe.

5. A coaxial, dual frequency feed assembly in accordance with claim 4, wherein said electronic switch means includes means for changing independently the polarization of incident energy received by said first probe and said second probe.

6. A coaxial, dual frequency feed assembly in accordance with claim 1, and further including:

a housing mounted to the rear of said body; and a signal processing circuit located within the housing, for receiving electromagnetic energy conducted from said first probe or said second probe, without any intervening waveguide structure.

7. A coaxial, dual frequency feed assembly, for receiving electromagnetic signals and conveying them to a signal utilization means outside of said coaxial feed assembly comprising:

a first body defining a front aperture and a first closed rear waveguide cavity therein having at least one sidewall and an end wall;

a first probe mounted within said first waveguide cavity for receiving electromagnetic energy in a first preselected band of frequencies;

means supporting said first probe in said first waveguide cavity;

first conducting means for conducting electromagnetic energy received by said first probe to the exterior of said first body;

first electronic switch means for changing the polarization of incident energy at said first probe;

first control lead means for operating said first electronic switch means;

whereby electromagnetic energy of selected polarization detected by said first probe may be conducted via said first conducting means to a signal utilization means;

a second body defining a second front aperture and second closer rear waveguide cavity therein of smaller dimension than said first closed rear waveguide cavity;

a second probe mounted within said second waveguide cavity for receiving electromagnetic energy in a second preselected band of frequencies, said second preselected band of frequencies being higher than said first band of frequencies;

support means supporting said second probe in said second waveguide cavity;

means mounting said second body with said second waveguide cavity located coaxially within said first waveguide cavity, said second body being spaced from each of the walls of said first waveguide cavity;

said support means including second electronic switch means for changing the polarization of incident energy at said second probe;

second control lead means for operating said second electronic switch means; and a coaxial line extending into said first waveguide cavity, spaced from said first probe, for conducting electromagnetic energy received by said second probe to the exterior of said assembly;

whereby the polarization of signals detected by said first probe is controlled by electrical control signals applied to said first electronic switch means via said first control lead means, and the polarization of signals detected by said second probe is controlled by electrical control signals applied to said second electronic switch means via said second control lead means.

8. A coaxial, dual frequency feed assembly in accordance with claim 7, wherein at least one of said first and second electronic switch means comprises a ferrite switch.

* * * * *